US011281131B2

(12) United States Patent
Taguchi

(10) Patent No.: US 11,281,131 B2
(45) Date of Patent: Mar. 22, 2022

(54) FIXING DEVICE INCLUDING SENSOR HOLDER FIXED TO FRAME

(71) Applicant: BROTHER KOGYO KABUSHIKI KAISHA, Nagoya (JP)

(72) Inventor: Kazuna Taguchi, Aichi (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/166,464

(22) Filed: Feb. 3, 2021

(65) Prior Publication Data

US 2021/0240112 A1 Aug. 5, 2021

(30) Foreign Application Priority Data

Feb. 4, 2020 (JP) ..... JP2020-016718

(51) Int. Cl.
*G03G 15/20* (2006.01)
*G03G 21/16* (2006.01)
*G03G 21/20* (2006.01)

(52) U.S. Cl.
CPC ..... *G03G 15/2017* (2013.01); *G03G 21/1685* (2013.01); *G03G 15/2039* (2013.01); *G03G 15/2064* (2013.01); *G03G 21/20* (2013.01); *G03G 2215/00084* (2013.01); *G03G 2221/1639* (2013.01)

(58) Field of Classification Search
CPC ..... G03G 15/2017; G03G 2221/1639; G03G 21/1685
USPC ..... 399/122, 320, 328; 219/216
See application file for complete search history.

(56) References Cited

U.S. PATENT DOCUMENTS 6,980,764 B2 * 12/2005 Otsuka ..... G03G 15/2053 399/328
8,498,561 B2 * 7/2013 Yamaguchi ..... G03G 15/2064 399/329
8,588,668 B2 * 11/2013 Ishii ..... G03G 15/2039 399/329
2014/0105657 A1 * 4/2014 Saiki ..... G03G 15/2053 399/329

FOREIGN PATENT DOCUMENTS

| | | | |
|---|---|---|---|
| JP | H03-145684 A | | 6/1991 |
| JP | 2000-172112 A | | 6/2000 |
| JP | 2002260825 A | * | 9/2002 |
| JP | 2016109724 A | * | 6/2016 |
| JP | 2019-015880 A | | 1/2019 |

* cited by examiner

*Primary Examiner* — Robert B Beatty
(74) *Attorney, Agent, or Firm* — Merchant & Gould P.C.

(57) ABSTRACT

A fixing device includes a first fixing member, a second fixing member, a heater, a temperature sensor, a sensor holder, and a first frame. The temperature sensor detects a temperature of the first fixing member or the second fixing member. The sensor holder is configured to hold the temperature sensor and is fixed on the first frame. The first frame is made of metal and includes a first bend, a second bend, a third bend, a first wall, a second wall, a third wall, and a fourth wall. The second wall is connected to the first wall via the first bend. The third wall is connected to the second wall via the second bend. The fourth wall is connected to the third wall via the third bend. The first wall and the second wall form an acute angle.

26 Claims, 7 Drawing Sheets

FIXING DEVICE INCLUDING SENSOR HOLDER FIXED TO FRAME

CROSS-REFERENCE TO RELATED APPLICATION(S)

This application claims priority from Japanese Patent Application No. 2020-016718 filed on Feb. 4, 2020, the disclosure of which is incorporated herein by reference in its entirety.

TECHNICAL FIELD

The present invention relates to a fixing device for thermally fixing a toner image on a sheet.

BACKGROUND ART

A fixing device known in the art comprises a heating member that heats a sheet, a temperature sensor that detects the temperature of the heating member, a plastic holder that holds the temperature sensor, and an L-shaped metal frame on which the holder is fixed.

SUMMARY

It would be desirable to increase the rigidity of the metal frame to improve positional accuracy of the temperature sensor.

In one aspect, a fixing device is disclosed herein, that comprises a first fixing member, a second fixing member, a heater, a temperature sensor, a sensor holder, and a first frame. The first fixing member includes a roller. The second fixing member is configured to form a nip in combination with the first fixing member. The heater heats the first fixing member or the second fixing member. The temperature sensor detects a temperature of the first fixing member or the second fixing member. The sensor holder is configured to hold the temperature sensor. The sensor holder is fixed on the first frame. The first frame is made of metal.

The first frame comprises a first bend, a second bend, a third bend, a first wall, a second wall, a third wall, and a fourth wall. The first bend, the second bend, and the third bend each form a bent shape in a cross section orthogonal to an axial direction of the roller. The second wall is connected to the first wall via the first bend. The third wall is connected to the second wall via the second bend. The fourth wall is connected to the third wall via the third bend.

The first wall and the second wall form an acute angle.

BRIEF DESCRIPTION OF THE DRAWINGS

The above and other aspects, their advantages and further features will become more apparent by describing in detail illustrative, non-limiting embodiments thereof with reference to the accompanying drawings, in which.

DESCRIPTION OF EMBODIMENTS

A detailed description will be given of a non-limiting embodiment with reference made to the drawings where appropriate.

Figure 1:
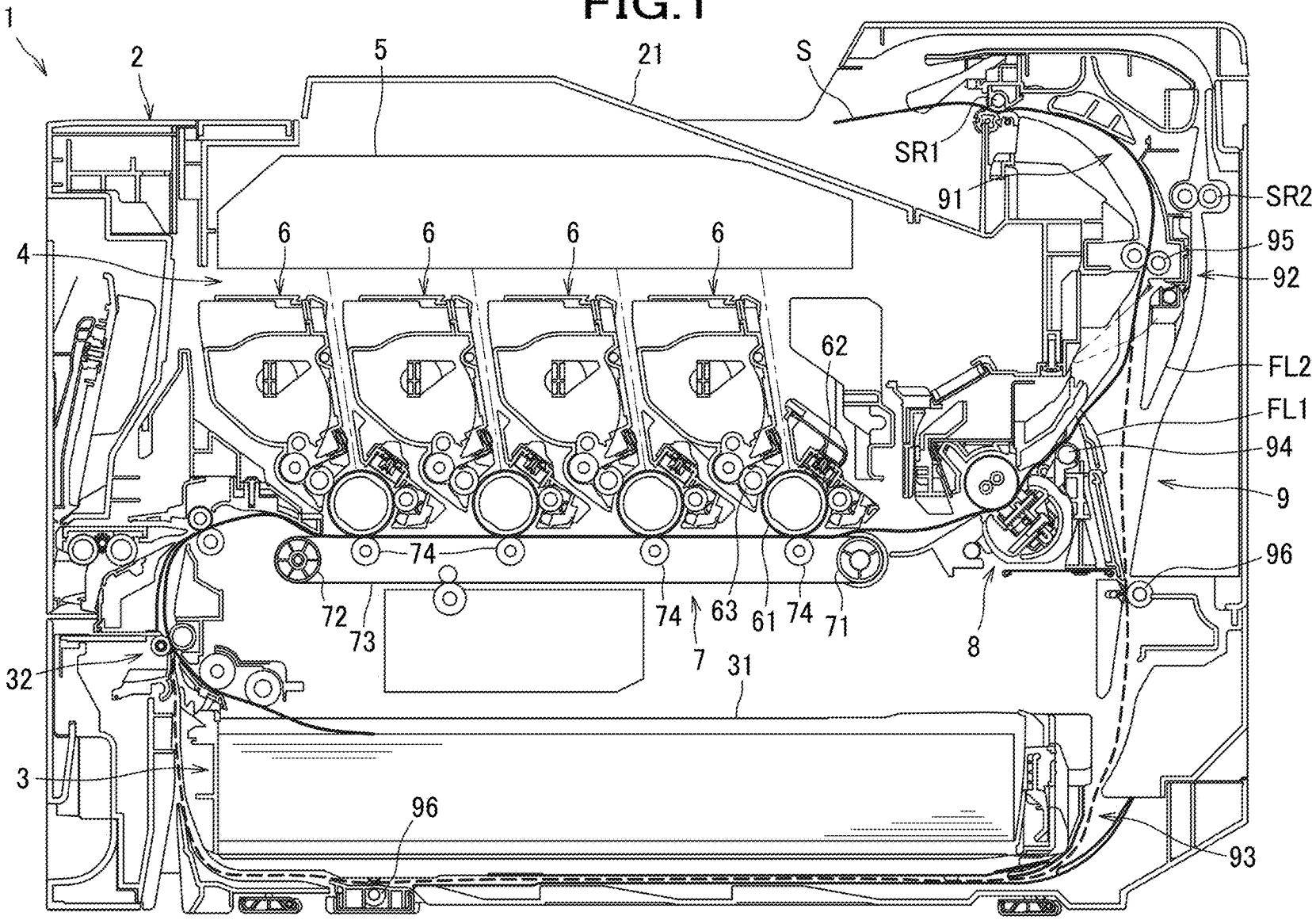
FIG. 1 is a sectional view of a color printer.

As shown in FIG. 1, a color printer 1 is configured to form an image on both sides of a sheet S (e.g., of paper). The color printer 1 comprises a housing 2, a feeder unit 3 arranged inside the housing 2, an image forming unit 4, a fixing unit 8, and a conveying unit 9.

The housing 2 comprises an output tray 21. The output tray 21 is provided on a top surface of the housing 2.

The feeder unit 3 is arranged in a lower part of the housing 2. The feeder unit 3 comprises a sheet tray 31 that holds sheets S, and a feeding mechanism 32 for feeding the sheets S in the sheet tray 31 to the image forming unit 4.

The image forming unit 4 has a function of transferring a toner image to a sheet S to form an image on the sheet S and comprises an exposure device 5, four process cartridges 6, and a transferring unit 7.

The exposure device 5 is provided in an upper part of the housing 2, and comprises a light source, a polygon mirror, etc. (not shown). The exposure device 5 is configured to rapidly scan a surface of a photoconductor drum 61 with a light beam (see alternate long and short dashed lines) in accordance with image data, to thereby expose the surface of the photoconductor drum 61 to light.

Each process cartridge 6 comprises the photoconductor drum 61, a charger 62, and a development roller 63. The four process cartridges 6 respectively contain toners of yellow, magenta, cyan, and black.

The transferring unit 7 comprises a drive roller 71, a follower roller 72, a conveyor belt 73, and four transfer rollers 74. The conveyor belt 73 is an endless belt that is looped around and runs between the drive roller 71 and the follower roller 72. The transfer rollers 74 are positioned on the inner side of the conveyor belt 73. The conveyor belt 73 is held between the transfer rollers 74 and corresponding photoconductor drums 61.

The surface of the photoconductor drum 61 is charged by the charger 62. Thereafter, the exposure device 5 exposes the surface of the photoconductor drum 61 to light to form an electrostatic latent image on the surface of the photoconductor drum 61 in accordance with the image data.

The development roller 63 supplies toner to the electrostatic latent image formed on the photoconductor drum 61. Accordingly, a toner image is formed on the photoconductor drum 61. Thereafter, a sheet S is conveyed by the conveyor belt 73 through between the photoconductor drum 61 and the transfer roller 74, so that the toner image on the photoconductor drum 61 is transferred to the sheet S.

The fixing device 8 thermally fixes the toner image on the sheet S. The details of the fixing device 8 will be described later.

The conveying unit 9 is configured to convey a sheet S ejected from the fixing device 8 to the outside of the housing 2 or toward the image forming device 4 again. The conveying unit 9 comprises a first conveyance path 91, a second conveyance path 92, a reconveyance path 93, a first conveyance roller 94, a second conveyance roller 95, a first switchback roller SR1, a second switchback roller SR2, a plurality of reconveyance rollers 96, a rotatable first flapper FL1, and a rotatable second flapper FL2.

The first conveyance path 91 guides a sheet S ejected from the fixing device 8 toward the output tray 21. The second conveyance path 92 guides a sheet S ejected from the fixing device 8 toward the output tray 21 along a route different from the first conveyance path 91. The reconveyance path 93 guides a sheet S drawn into the housing 2 to the feeding mechanism 32 upstream of the image forming unit 4. The sheet S is drawn into the housing 2 by the first switchback roller SR1 which will be described later. The reconveyance rollers 96 are provided in the reconveyance path 93 and convey a sheet S in the reconveyance path 93 toward the feeding mechanism 32.

The first conveyance roller 94 is provided in the fixing device 94. The first conveyance roller 94 conveys a sheet S with a toner image thermally fixed thereon toward the second flapper FL2.

The second conveyance roller 95, the first switchback roller SR1, and the second switchback roller SR2 are rotatable in forward and reverse directions. The second conveyance roller 95, the first switchback roller SR1, and the second switchback roller SR2 convey a sheet S toward the outside of the housing 2, specifically to the output tray 21 when rotated in the forward direction, and draw a sheet S into the housing 2 when rotated in the reverse direction.

The second conveyance roller 95 and the first switchback roller SR1 are provided in the first conveyance path 91. The first switchback roller SR1 is located closer to the output tray 21 than the second conveyance roller 95. The second switchback roller SR2 is provided in the second conveyance path 92.

The appropriate switching of the positions of the first flapper FL1 and the second flapper FL2 allows the conveying unit 9 to convey a sheet S from the fixing device 8 toward the first conveyance path 91 or the second conveyance path 92, or to convey a sheet S from the first conveyance path 91 or the second conveyance path 92 to the reconveyance path 93.

Figure 2:
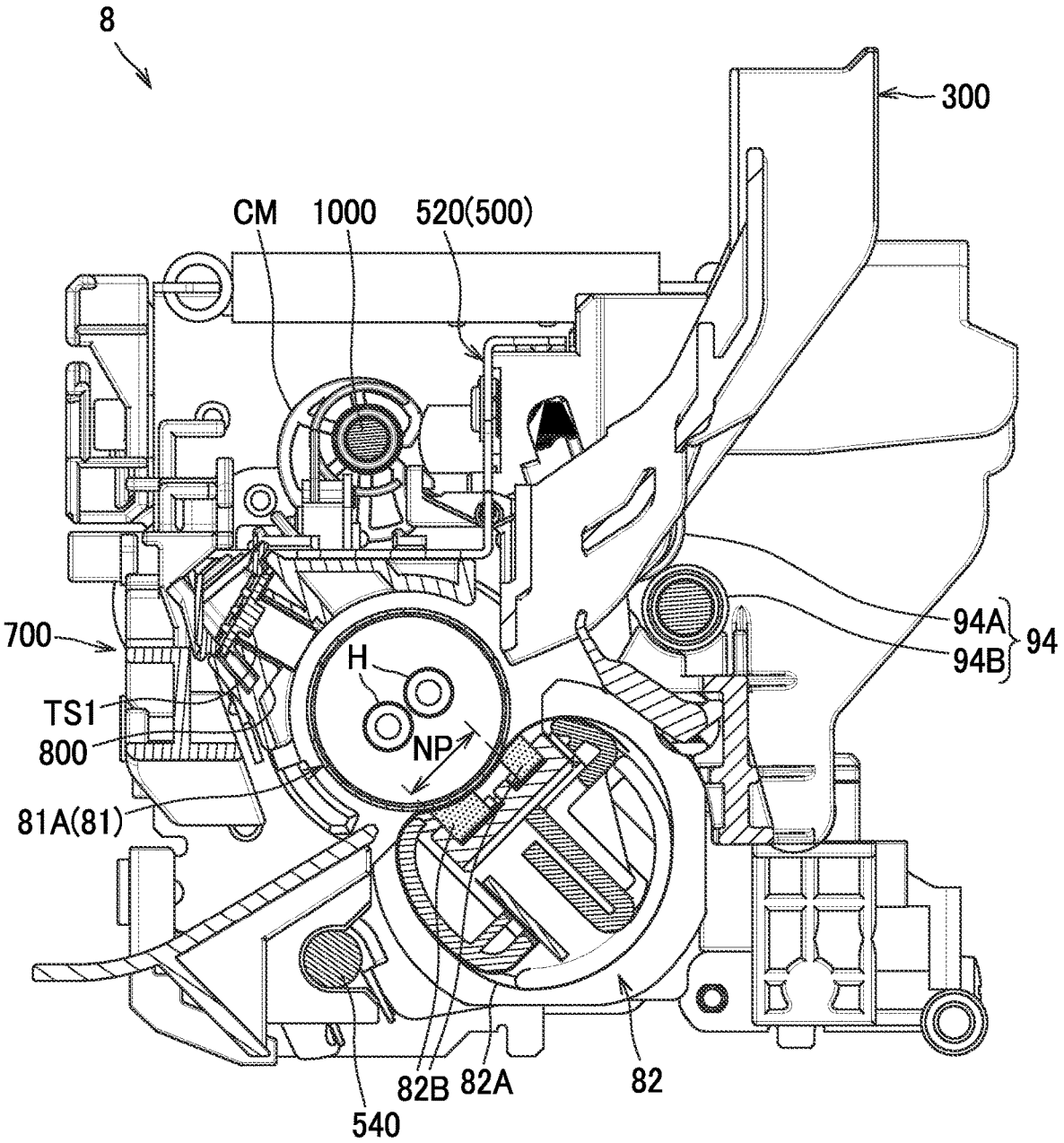
FIG. 2 is a sectional view of a fixing device including a center thermistor.

As shown in FIG. 2, the fixing device 8 comprises two heaters H, a first fixing member 81, a second fixing member 82, a center thermistor TS1 as an example of a temperature sensor, a sensor holder 800, a fixing frame 500, an upstream guide 700, and a rear guide 300. The fixing frame 500 is made of metal. The sensor holder 800, the upstream guide 700, and the rear guide 300 are made of plastic or the like.

The first fixing member 81 comprises a rotatable roller 81A. The two heaters H are arranged inside the roller 81A and heat the first fixing member 81.

The second fixing member 82 forms a nip NP in combination with the first fixing member 81. The nip NP is formed between the first fixing member 81 and the second fixing member 82. The second fixing member 82 comprises an endless belt 82A, and two pads 82B. The belt 82A is sandwiched between the first fixing member 81 and the two pads 82B.

The center thermistor TS1 is a noncontact sensor that detects the temperature of the first fixing member 81 heated by the heaters H. To be more specific, the center thermistor TS1 detects the temperature of the roller 81A approximately in the midsection of the roller 81A between the axial ends of the roller 81A. The center thermistor TS1 is located at a distance from the roller 81A. In this description, the direction of the rotation axis of the roller 81A is also simply referred to as "axial direction".

The sensor holder 800 is a member that holds the center thermistor TS1. The fixing frame 500 includes an upper frame 520 as an example of a first frame. The sensor holder 800 is fixed to the upper frame 520.

The upstream guide 700 guides a sheet S at a location upstream of the nip NP in a conveyance direction of the sheet S. In this description, the conveyance direction of the sheet is also simply referred to as "conveyance direction".

The rear guide 300 guides a sheet S ejected from the nip NP. The rear guide 300 supports a first roller 94A in a manner that permits the first roller 94A to rotate. The first roller 94A is paired with a second roller 94B and located above the second roller 94B. The first roller 94A and the second roller 94B constitute the first conveyance roller 94 described above.

Figure 3:
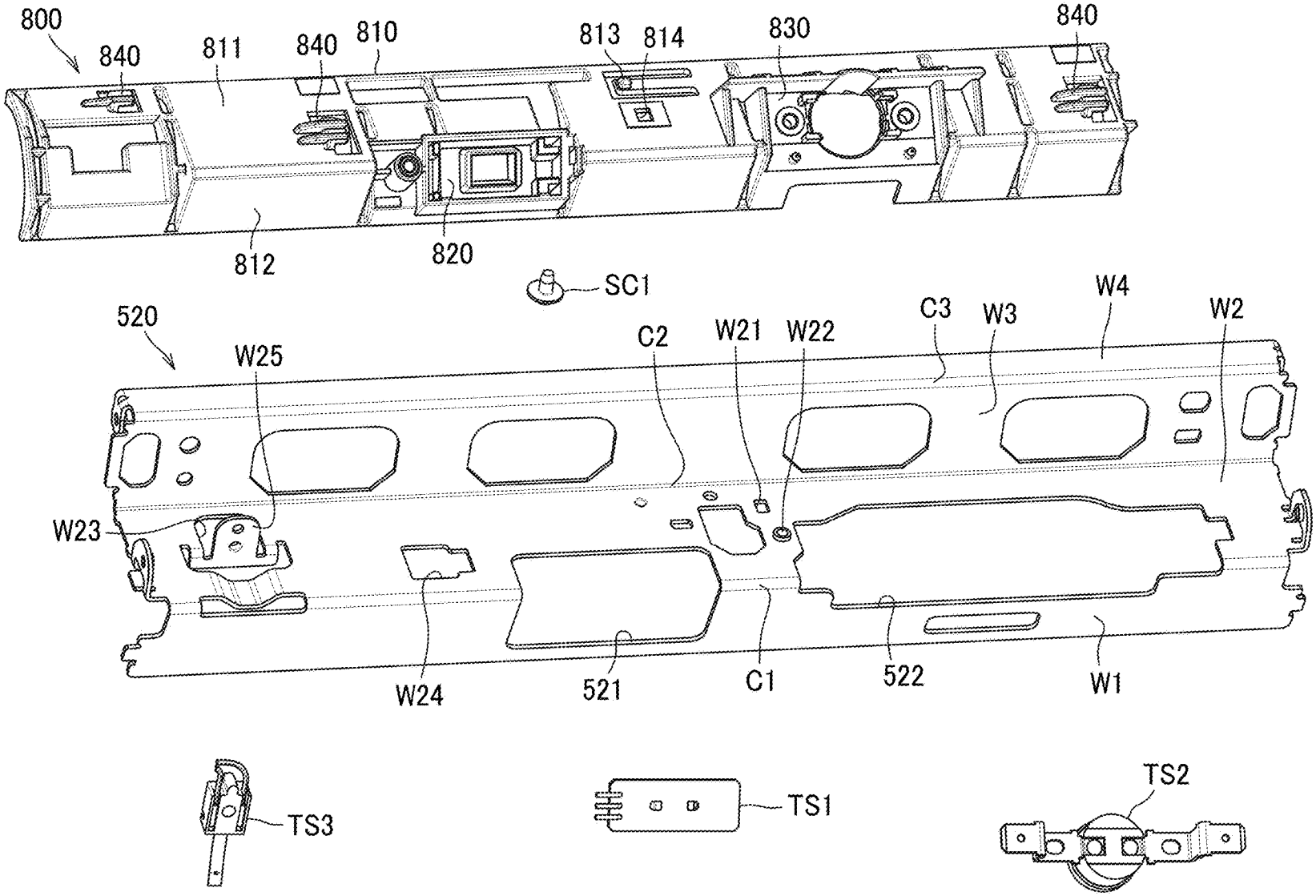
FIG. 3 is an exploded perspective view showing an upper frame and a sensor holder.

The upper frame 520 is formed of sheet metal with a shape of a letter W in a cross section orthogonal to the axial direction. As shown in FIG. 3, the upper frame 520 comprises a first bend C1, a second bend C2, a third bend C3, a first wall W1, a second wall W2, a third wall W3, and a fourth wall W4.

Figure 4:
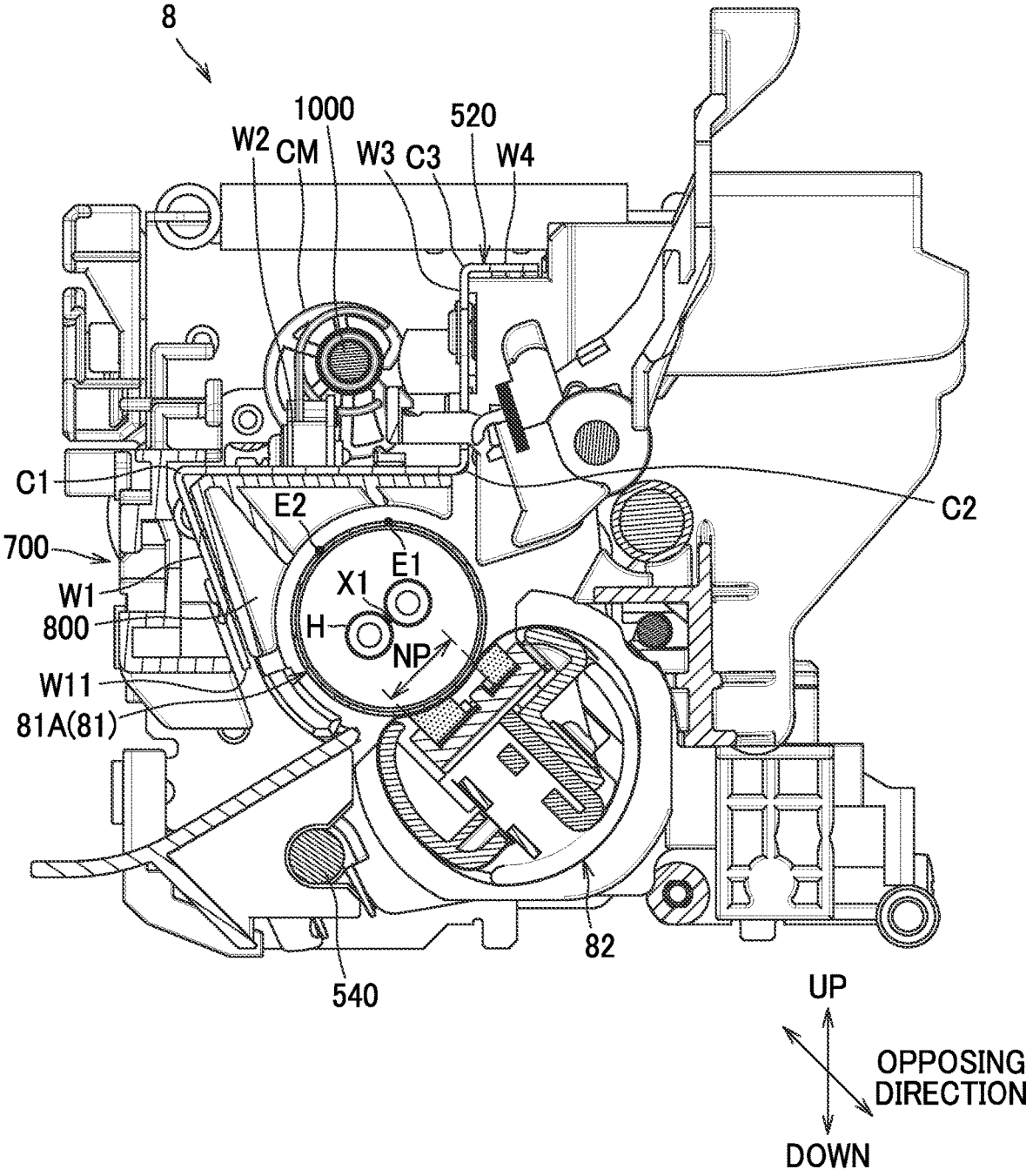
FIG. 4 is a sectional view of the fixing device including a first bend.

As shown in FIG. 4, the first bend C1, the second bend C2, and the third bend C3 each form a bent shape in a cross section orthogonal to the axial direction. The first bend C1 is connected to the first wall W1 and the second wall W2. The second bend C2 is connected to the second wall W2 and the third wall W3. The third bend C3 is connected to the third wall W3 and the fourth wall W4.

In other words, the second wall W2 is connected to the first wall W1 via the first bend C1. The third wall W3 is connected to the second wall W2 via the second bend C2. The fourth wall W4 is connected to the third wall W3 via the third bend C3.

The second bend C2 is bent in a direction opposite to a direction in which the first bend C1 and the third bend C3 are bent. To be more specific, for example, if the first bend C1 and the third bend C3 are configured as mountain folds, the second bend C2 is configured as a valley fold. The second bend C2 and the third bend C3 each form a right angle, whereas the first bend C1 forms an acute angle.

In other words, the first wall W1 and the second wall W2 form an acute angle, the second wall W2 and the third wall W3 form a right angle, and the third wall W3 and the fourth wall W4 form a right angle.

The first wall W1 is arranged upstream of the nip NP in the conveyance direction of a sheet S. The first bend C1 is bent from an upper end of the first wall W1 toward a downstream side in the conveyance direction.

The second wall W2 extends along a horizontal plane from the first bend C1 toward the downstream side in the conveyance direction. The second bend C2 is bent from a downstream end of the second wall W2 in a direction away from the first fixing member 81. The first bend C1 is bent downward from an upstream end of the second wall W2 in the conveyance direction. The second bend C2 is bent upward from the downstream end of the second wall W2 in the conveyance direction. That is, the first bend C1 bends downward and the second bend C2 bends upward.

The third wall W3 is located downstream of the nip NP in the conveyance direction. The third bend C3 is bent from an upper end of the third wall W3 toward the downstream side in the conveyance direction. That is, the second bend C2 and the third bend C3 bend in opposite directions orthogonal to a surface of the third wall W3.

The fourth wall W4 extends from the third bend C3 toward the downstream side in the conveyance direction. The fourth wall W4 is parallel to the second wall W2.

The second wall W2 is arranged over the roller 81A. The first wall W1 extends downward from the first bend C1. A lower end W11 of the first wall W1 is located below an upper end E1 of the roller 81A, more specifically, below the axis X1 of the roller 81A.

In other words, the second wall W2 is located on a side of the first fixing member 81 which is opposite to a side on which the second fixing member 82 is located, in an opposing direction in which the first fixing member 81 and the second fixing member 82 are opposed to each other. The first wall W1 extends from the first bend C1 on the second fixing member 82 side with respect to a plane orthogonal to the opposing direction and intersecting the first bend C1. The lower end W11 of the first wall W1 located on the second fixing member 82 side is located is closer to a plane orthogonal to the opposing direction and intersecting the second fixing member 82 than a point E2 of the roller 81A farthest from the plane.

The lower end W11 of the first wall W1 may be located closer to the plane orthogonal to the opposing direction and intersecting the second fixing member 82 than the axis X1 of the roller 81A.

The upper frame 520 includes a part arranged between the upstream guide 700 and the heater H. To be more specific, the first wall W1, the first bend C1, and a part of the second wall W2 are arranged between the upstream guide 700 and the heater H. The upstream guide 700 is spaced apart from the upper frame 520. That is, the upstream guide 700 and the upper frame 520 are arranged with a gap left therebetween so that they do not contact each other.

As shown in FIG. 3, the sensor holder 800 comprises a base 810, a first holder 820 configured to hold the center thermistor TS1, a second holder 830 configured to hold a thermostat TS2, and three engagement claws 840. The base 810 is elongated in the axial direction. The thermostat TS2 is connected to a harness HN shown in FIG. 5 for supplying electric power to the heater H and has a function of interrupting the supply of electric power to the heater H when the heater H is overheated.

The base 810 comprises an upper surface 811 that faces the second wall W2 of the upper frame 520 from below, and a front surface 812 that faces the first wall W1 of the upper frame 520 from the downstream side in the conveyance direction. The base 810 has a locating protrusion 813 and a hole 814 on the upper surface 811.

The second wall W2 of the upper frame 520 has a locating hole W21 that engages with the locating protrusion 813, and a mounting hole W22 formed in a position corresponding to hole 814. The sensor holder 800 is fixed to the second wall W2 by inserting a screw SC1 into the hole 814 of the sensor holder 800 and fastening the screw SC1 to the mounting hole W22 of the second wall W2.

The first holder 820 and the second holder 830 protrude from the upper surface 811 and the front surface 812. The upper frame 520 has a first opening 521 through which the first holder 820 extends and a second opening 522 through which the second holder 830 extends. The first opening 521 and the second opening 522 are formed across the first wall W1, the first bend C1, and the second wall W2.

The engagement claws 840 are provided for temporary holding the sensor holder 800 on the second wall W2. The engagement claws 840 protrude upward from the upper surface 811 of the base 810 and then extend in one direction along the axial direction. The three engagement claws 840 are configured to extend through the holes W23, W24 and the second opening 522 formed in the second wall W2 and to engage the edges of the holes W23, W24 and the second opening 522 from above.

The second wall W2 has an attachment flange W25 for attaching a side thermistor TS3. The side thermistor TS3 is a sensor that contacts an axial end of the roller 81A and detects a temperature of the roller 81A.

Figure 5:
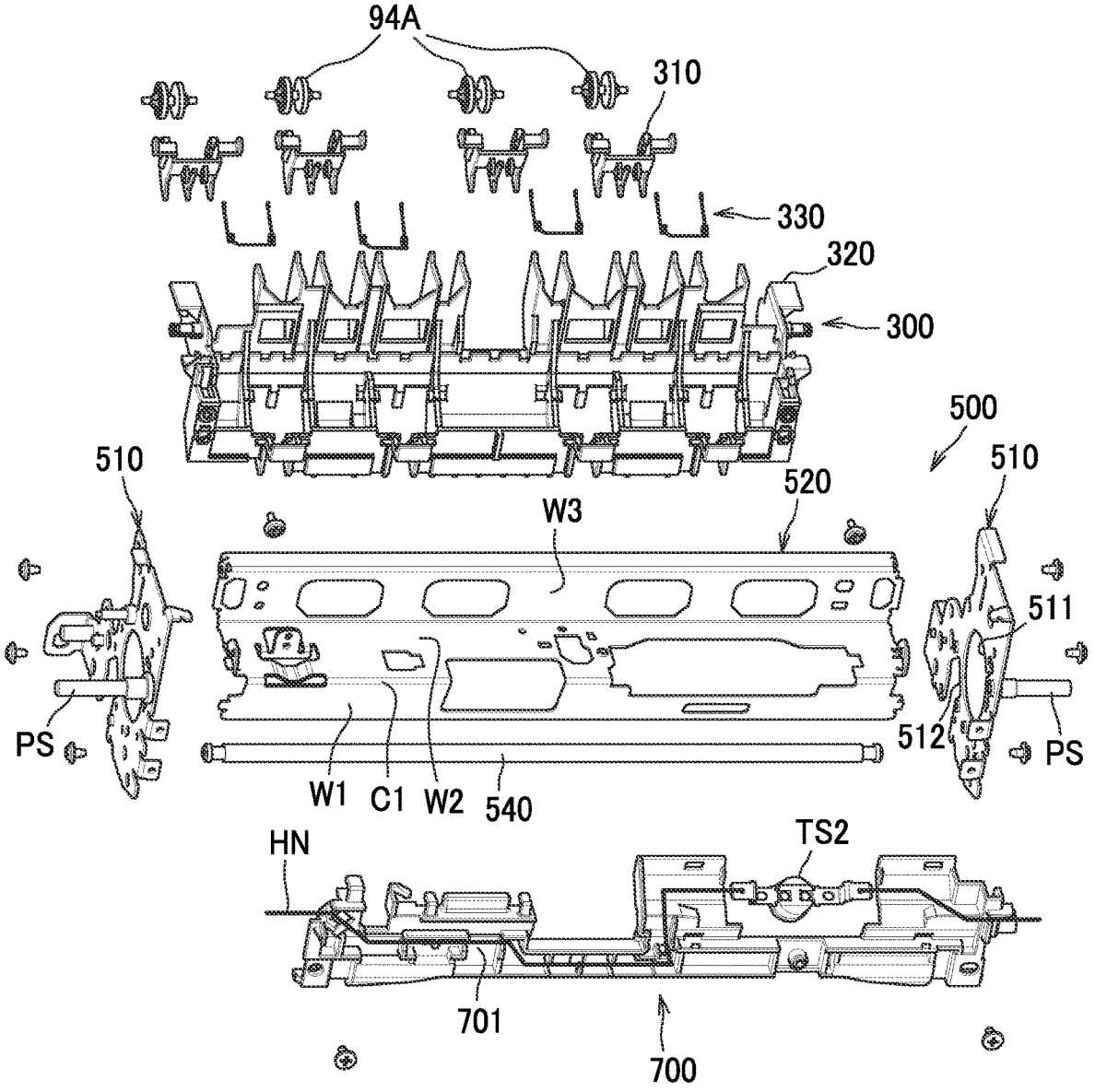
FIG. 5 is an exploded perspective view showing a fixing frame, a rear guide, and an upstream guide.

As shown in FIG. 5, the fixing frame 500 comprises, in addition to the upper frame 520 described above, side frames 510 as an example of a second frame, and a support shaft 540. One side frame 510 is arranged on each end of the upper frame 520 elongate in the axial direction and fixed thereto.

Each side frame 510 has a support hole 511 that supports the first fixing member 81 via a bearing (not shown), and a support groove 512 that supports the second fixing member 82 in such a manner as to allow the second fixing member 82 to move along the opposing direction. Each end of the support shaft 540 is fixed to a corresponding side frame 510.

Each side frame 510 has a positioning shaft PS fixed thereon by staking. When the fixing device 8 is assembled in the housing 2, the positioning shaft PS is inserted in a recess formed in a frame of the housing 2. In this way, the fixing device 8 can be located in a predetermined position inside the housing 2.

Figure 7:
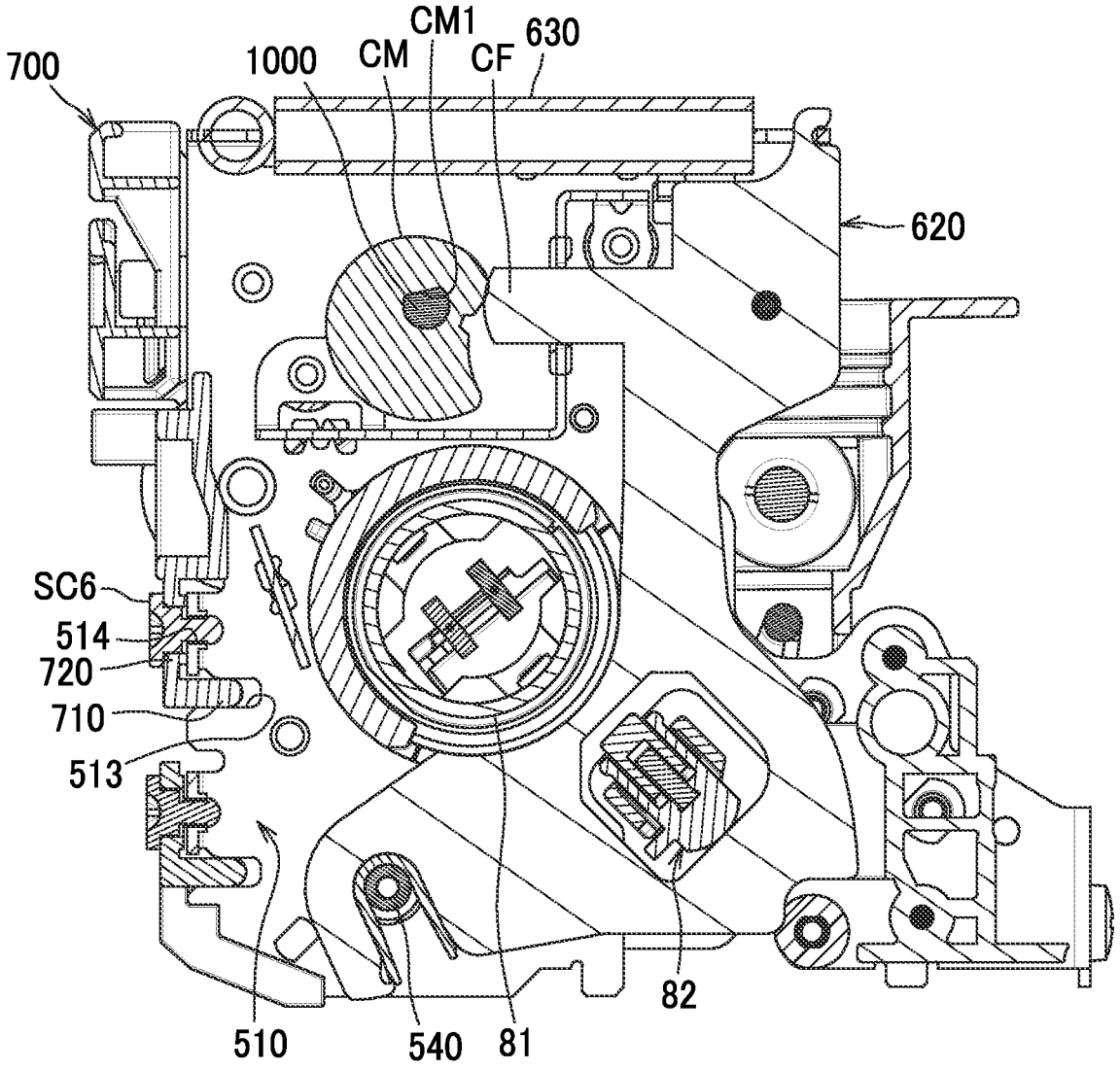
FIG. 7 is a sectional view of a fixing device including an arm.

As shown in FIG. 7, the support shaft 540 supports an arm 620 in a manner that permits the arm 620 to rotate. The arm 620 presses the second fixing member 82 against the first fixing member 81. A spring 630 that biases the arm 620 toward the first fixing member 81 is provided between the arm 620 and the side frame 510. The cam CM is supported on a cam shaft 1000. The cam CM has a hole CM1 having a shape of a letter D. An end portion of the cam shaft 1000 has a shape of a letter D. The D-shaped end portion is fit into the hole CM1 so that the cam CM and the cam shaft 1000 rotate together. The side frame 510 supports the cam shaft 1000 in a manner that permits the cam CM to rotate. The cam CM is configured to press a cam follower CF formed on the arm 620 against the biasing force of the spring 630. This allows the nip pressure at the nip NP to be adjusted.

As shown in FIG. 5, the rear guide 300 comprises roller holders 310 that support the first rollers 94A in a manner that permits the first rollers 94A to rotate, a guide body 320 that supports the roller holders 310 in a manner that permits the roller holders 310 to rotate, and torsion springs 330 that bias the first rollers 94A toward the second rollers 94B (see FIG. 2). The guide body 320 is fixed to the third wall W3 of the upper frame 520.

As shown in FIG. 4, the upstream guide 700 is arranged so as to cover the sides of the first wall W1, the first bend C1, and the second wall W2 of the upper frame 520 facing away from the heater H. The upstream guide 700 is spaced apart from the first wall W1, the first bend C1, and the second wall W2 and fixed to each side frame 510.

As shown in FIG. 5, a harness HN for supplying electric power to the heater H is arranged on a surface 701 of the upstream guide 700 facing away from the upper frame 520. The harness described above which is connected to the center thermistor TS1 and the side thermistor TS3 is also arranged on the surface 701 of the upstream guide 700 facing away from the upper frame 520.

Next, the structure for assembling the fixing frame 500, the rear guide 300, and the upstream guide 700 at both ends will be explained with reference to FIG. 6. Since the structure at one end is similar to the structure at the other end, only the structure at one end will be explained.

Figure 6:
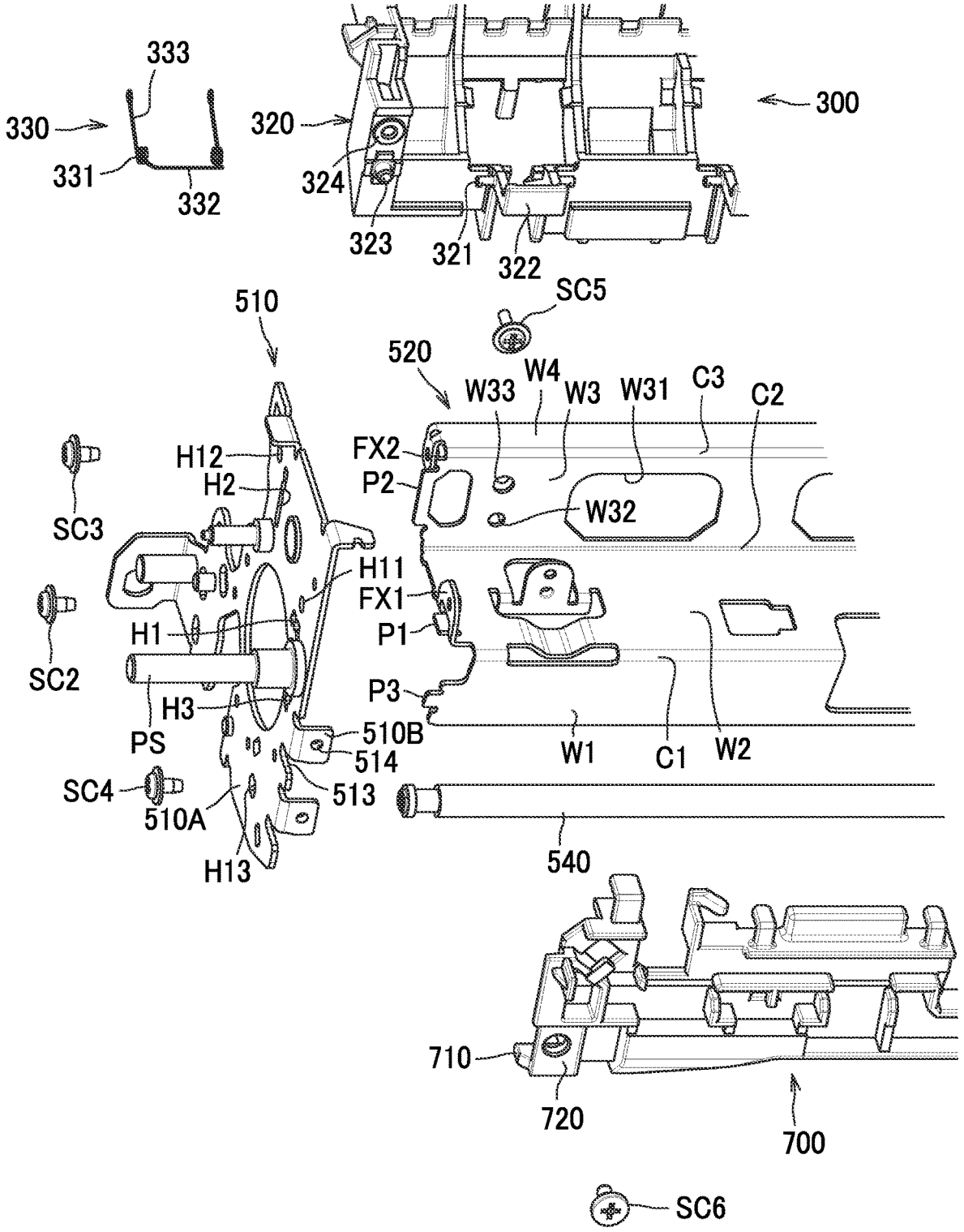
FIG. 6 is an exploded perspective view enlarged to show ends of the fixing frame, the rear guide, and the upstream guide.

As shown in FIG. 6, the second wall W2 of the upper frame 520 includes a first protrusion P1 protruding in the axial direction on each end. The side frame 510 has a first engagement hole H1 that engages with the first protrusion P1. The second wall W2 includes a first screw-fastening portion FX1 on each end that is fastened onto the side frame 510 by a screw SC2. The first screw-fastening portion FX1 extends upward from a periphery of the first protrusion P1. A hole H11 that receives the screw SC2 is formed in the side frame 510.

The first screw-fastening portion FX1 and the first protrusion P1 are located closer to the first bend C1 than to the second bend C2. More specifically, the distance from the first bend C1 to the first screw-fastening portion FX1 and the first protrusion P1 is shorter than the distance from the first screwing portion FX1 and the first protrusion P1 to the second bend C2, in a direction from the first bend C1 toward the second bend C2. The direction from the first bend C1 to the second bend C2, put in another way, is the width direction of the second wall W2.

The third wall W3 includes a second protrusion P2 that protrudes in the axial direction on each end. The side frame 510 has a second engagement hole H2 that engages with the second protrusion P2.

The fourth wall W4 includes a second screw-fastening portion FX2 on each end that is fastened onto the side frame 510 by a screw SC3. The second screw-fastening portion FX2 extends from an end of the fourth wall W4 so as to approach the second protrusion P2, to be more specific, downward. The extreme end of the second screw-fastening portion FX2 is located adjacent to the second protrusion P2. A hole H12 that receives the screw SC3 is formed in the side frame 510.

The first wall W1 includes a third protrusion P3 that protrudes in the axial direction on each end. The side frame 510 has a third engagement hole H3 that engages with the third protrusion P3. The side frame 510 has a hole H13 that receives a screw SC4 that is fixed on an end of the support shaft 540.

The torsion spring 330 comprises coils 331, a first arm 332, and second arms 333. The first arm 332 extends from the coils 331 in one direction and engages with the guide body 320. Each of the second arms 333 extends from a corresponding coil 331 in another direction and engages with the roller holder 310 (see FIG. 5). The guide body 320 comprises a shaft 321 that supports the coil 331, and an arm engagement portion 322 that engages with the first arm 332. The third wall W3 has a hole W31 through which the arm engagement portion 322 extends.

The guide body 320 includes on each end a protrusion 323 that protrudes toward the third wall W3, and a screw-fastening portion 324 that is fastened onto the third wall W3 by a screw SC5. The third wall W3 has at each end an engagement hole W32 that engages with the protrusion 323, and a hole W33 that receives the screw SC5.

The upstream guide 700 includes on each end a protrusion 710 that protrudes toward the side frame 510, and a screw-fastening portion 720 that is fastened onto the side frame 510 by a screw SC6. As shown in FIGS. 6 and 7, the side frame 510 has an engagement groove 513 that engages with the protrusion 710 and a hole 514 to which a screw SC6 is fastened.

More specifically, the side frame 510 includes a base 510A and a flange 510B. Various holes, such as the first engagement hole H1 for attaching the upper frame 520 etc., are formed in the base 510A. The flange 510B extends from an end of the base 510A on the upstream guide 700 side toward the upper frame 520. The hole 514 is formed in the flange 510B. The engagement groove 513 is formed on the end of the base 510A on the upstream guide 700 side adjacent to the flange 510B.

In the illustrative, non-limiting embodiment described above, the following advantageous effects can be achieved.

Since the rigidity of the upper frame 520 can be increased by forming the first bend C1 of the upper frame 520 at an acute angle, the center thermistor TS1 and the thermostat TS2 which are held on the rigidity-increased upper frame 520 via the sensor holder 800 can be provided with improved positional accuracy.

Since the sensor holder 800 is fixed to the second wall W2 connected to the first bend C1 forming an acute angle and thus provided with an increased rigidity, the positional accuracy of the center thermistor TS1 and the thermostat TS2 can be further improved.

Since the upper frame 520 has the openings 521, 522 through which a part of the sensor holder 800 extends, the sensor holder 800 can be properly fixed to the second wall W2 even if the sensor holder 800 has a complex shape.

Since the lower end W11 of the first wall W1 is located below the axis X1 of the roller 81A, the width of the first wall W1 becomes greater compared to a structure where the lower end of the first wall is located above the axis of a roller, and thus the rigidity of the second wall W2 increases. Further, since it is possible to surround the roller 81A with the first wall W1 and the second wall W2, air heated by the roller 81A can be restrained from escaping from the upper frame 520.

Since the first protrusion P1 engages with the first engagement hole H1, the second wall W2 on which the sensor holder 800 is fixed is positioned on the side frame 510, and thus the positional accuracy of the center thermistor TS1 can be improved.

Since the second wall W2 includes the first screw-fastening portion FX1 and the first protrusion P1, it is possible to arrange the first screw-fastening portion FX1 near the first protrusion P1, and thus the positional accuracy of the first screw-fastening portion FX1 with respect to the first protrusion P1 can be improved.

Since the first screw-fastening portion FX1 and the first protrusion P1 are arranged closer to the first bend C1 having an increased rigidity, the fixing strength and positional accuracy of the upper frame 520 can be improved.

Since the third wall W3 is positioned in place on the side frame 510 by the second protrusion P2 engaging with the second engagement hole H2, the positional accuracy of the upper frame 520 can be improved. Further, the positional accuracy of the rear guide 300 fixed to the third wall W3 can be improved.

Since the second screw-fastening portion FX2 extends so as to approach the second protrusion P2, it is possible to arrange the second screw-fastening portion FX2 near the second protrusion P2, and thus the positional accuracy of the second screw-fastening portion FX2 with respect to the second protrusion P2 can be improved.

Since a gap is left between the upstream guide 700 and the upper frame 520, the transfer of heat from the upper frame 520 to the upstream guide 700 can be restrained.

Since the harness HN is located on the surface 701 of the upstream guide 700 facing away from the upper frame 520, the transfer of heat from the heater H to the harness HN can be restrained by the upstream guide 700, and thus the temperature of the harness HN can be restrained from increasing.

The present invention is not limited to the above-described embodiment and may be implemented in various other forms as described below.

Although the first fixing member 81 is heated by a heater H in the above-described embodiment, the second fixing member may be heated by a heater. In this case, the temperature sensor may be arranged to detect the temperature of the second fixing member.

The first fixing member 81 described above is exemplified as a cylindrical roller including a heater H. However, the first fixing member may be a pressure roller including a shaft and a rubber layer formed around the shaft or may be an endless belt with an inner peripheral surface heated by a heater. An outside heating system where a heater is arranged outside the first fixing member to heat an outer peripheral surface of the first fixing member or an IH (Induction Heating) system is also possible. Further, a heater may be provided in the second fixing member so that the first fixing member contacting the outer peripheral surface of the second fixing member may be indirectly heated. Also, the first fixing member and the second fixing member may each include a heater. The second fixing member may be a pressure roller including a shaft and a rubber layer formed around the shaft.

Although one bend of the plurality of bends of the upper frame 520 described above forms an acute angle, there may be a plurality of acutely-angled bends. In the above-described embodiment, the first bend forms an acute angle, but the second bend and/or the third bend may form an acute angle. Further, it is sufficient if there is at least one bend that forms an acute angle, and the other bends may form an obtuse angle.

However, for the reason described below, it is preferable that only the first bend C1 forms an acute angle. When a sheet metal having a high rigidity is bent to form an acute angle using a stamping die, it is necessary to bend the sheet metal to an angle of 90 degrees in one die and then bend the sheet metal further in a different die. Therefore, the cost for equipment of the dice increases and/or the work process becomes complicated if the number of bends forming an acute angle increases. Thus the number of bends that form an acute angle is preferably one. Further, an acute bend formed by two pressing processes as described above would make the precision of the angle lower. Since the sensor holder 800 and the rear guide 300 are attached to the surface of the second wall W2 and the third wall W3, it is desirable to increase positional accuracy of the second wall W2 and the third wall W3. Thus, the second bend C2 is preferably bent at 90 degrees. Since the fourth wall W4 includes a second screw-fastening portion FX2 at its ends, the second screw-fastening portion FX2 cannot be arranged if the third bend C3 forms an acute angle. Thus, it is preferable that only the angle of the first bend C1, that is, the angle formed by the surface of the first wall W1 and the surface of the second wall W2 be an acute angle.

The temperature sensor exemplified in the above description is a center thermistor TS1 that detects the temperature of the first fixing member without contacting the first fixing member. However, the temperature sensor may detect the temperature of the ends of the first fixing member or the second fixing member as the side thermistor TS3, or may contact the first fixing member or the second fixing member to detect the temperature.

Although the sensor holder 800 described above is fixed to the second wall W2, the sensor holder may be fixed to another wall such as the first wall.

Although the first frame and the second frame described above are fixed together by screws, the first frame and the second frame may be fixed by other fixing methods. Alternative fixing methods may include a method using a plastic clip to fix the frames or a method that fixes the frames by tightly fitting a plastic dowel into the frames.

The elements described in the above embodiment and its modified examples may be implemented selectively and in combination.

What is claimed is:

1. A fixing device comprising:
- a heater;
- a first fixing member including a roller, the heater being arranged inside the roller;
- a second fixing member configured to form a nip in combination with the first fixing member;
- a temperature sensor that detects a temperature of the first fixing member or the second fixing member;
- a sensor holder configured to hold the temperature sensor; and
- a first frame on which the sensor holder is fixed, the first frame being made of metal,
- wherein the first frame comprises:
  - a first bend, a second bend, and a third bend each of which has a bent shape in a cross section orthogonal to an axial direction of the roller;
  - a first wall;
  - a second wall connected to the first wall via the first bend;
  - a third wall connected to the second wall via the second bend; and
  - a fourth wall connected to the third wall via the third bend, and
- wherein the first wall and the second wall form an acute angle, and
- wherein the first frame is located outside of the roller.

2. The fixing device according to claim 1,
- wherein the temperature sensor is configured to detect a temperature of the first fixing member.

3. The fixing device according to claim 1, wherein the sensor holder is fixed to the second wall.

4. The fixing device according to claim 3, wherein the first frame has an opening formed across the first wall, the first bend, and the second wall, a part of the sensor holder extending through the opening.

5. The fixing device according to claim 1,
- wherein the second wall is arranged over the roller,
- wherein the first wall extends downward from the first bend, and
- wherein a lower end of the first wall is located below an upper end of the roller.

6. The fixing device according to claim 5, wherein the lower end of the first wall is located below an axis of the roller.

7. The fixing device according to claim 1, wherein the second wall is located on a side of the first fixing member which is opposite to a side on which the second fixing member is located, in an opposing direction in which the first fixing member and the second fixing member are opposed to each other,
- wherein the first wall extends from the first bend so as to approach the second fixing member, and
- wherein an end of the first wall on the side on which the second fixing member is located is closer to a plane orthogonal to the opposing direction and intersecting the second fixing member than a point of the roller farthest from the plane.

8. The fixing device according to claim 1, further comprising a second frame,
- wherein the first frame has an end facing outward in the axial direction, and the second frame is fixed to the end of the first frame.

9. The fixing device according to claim 8, wherein the second wall includes a first protrusion that protrudes in the axial direction, and wherein the second frame has a first engagement hole that engages with the first protrusion.

10. The fixing device according to claim 9, wherein the second wall includes a first screw-fastening portion that is fastened onto the second frame by a screw.

11. The fixing device according to claim 10, wherein a distance from the first bend to the first screw-fastening portion is shorter than a distance from the second bend to the first screw-fastening portion, and a distance from the first bend to the first protrusion is shorter than a distance from the second bend to the first protrusion, in a direction from the first bend toward the second bend.

12. The fixing device according to claim 8, wherein the third wall includes a second protrusion that protrudes in the axial direction, and wherein the second frame has a second engagement hole that engages with the second protrusion.

13. The fixing device according to claim 12, wherein the fourth wall includes a second screw-fastening portion that is fastened onto the second frame by a screw, the second screw-fastening portion extending so as to approach the second protrusion.

14. The fixing device according to claim 1, wherein the first frame has a shape of a letter W in a cross section orthogonal to the axial direction.

15. The fixing device according to claim 14, wherein the first wall is arranged upstream of the nip in a conveyance direction of a sheet, wherein the third wall is located downstream of the nip in the conveyance direction, wherein the second wall is parallel to the fourth wall, wherein the second bend and the third bend each form a right angle, and wherein the second bend is bent in a direction opposite to a direction in which the first bend and the third bend are bent.

16. The fixing device according to claim 1, wherein the sensor holder is located between the first frame and the roller.

17. A fixing device comprising:

a first fixing member including a roller;

a second fixing member configured to form a nip in combination with the first fixing member;

a heater that heats the first fixing member or the second fixing member;

a temperature sensor that detects a temperature of the first fixing member or the second fixing member;

a sensor holder configured to hold the temperature sensor;

a first frame on which the sensor holder is fixed, the first frame being made of metal; and a second frame configured to support the first fixing member or the second fixing member, wherein the first frame comprises:

a first bend, a second bend, and a third bend each of which has a bent shape in a cross section orthogonal to an axial direction of the roller;

a first wall;

a second wall connected to the first wall via the first bend;

a third wall connected to the second wall via the second bend; and a fourth wall connected to the third wall via the third bend, wherein the first wall and the second wall form an acute angle, wherein the first frame is located outside of the roller, and wherein the first frame has an end facing outward in the axial direction, and the second frame is fixed to the end of the first frame.

18. The fixing device according to claim 17, further comprising:

an upstream guide configured to guide a sheet at a location upstream of the nip in a conveyance direction of the sheet.

19. The fixing device according to claim 18, wherein the first frame includes a part arranged between the upstream guide and the heater.

20. The fixing device according to claim 18, wherein the upstream guide is spaced apart from the first frame and fixed to the second frame.

21. The fixing device according to claim 18, further comprising a harness for supplying electric power to the heater;

wherein the harness is located on a surface of the upstream guide facing away from the first frame.

22. A fixing device comprising:

a heater;

a first fixing member including a roller, the heater being arranged inside the roller;

a second fixing member configured to form a nip in combination with the first fixing member; and a frame being made of metal, comprising:

a first bend, a second bend, and a third bend each of which has a bent shape in a cross section orthogonal to an axial direction of the roller;

a first wall;

a second wall connected to the first wall via the first bend;

a third wall connected to the second wall via the second bend; and a fourth wall connected to the third wall via the third bend, wherein the frame is located outside of the roller, and wherein the frame has a shape of a letter W in a cross section orthogonal to the axial direction.

23. The fixing device according to claim 22, wherein the first wall and the second wall form an acute angle.

24. The fixing device according to claim 22, further comprising:

a temperature sensor configured to detect a temperature of the first fixing member; and a sensor holder configured to hold the temperature sensor, wherein the sensor holder is fixed on the frame and is located between the frame and the roller.

25. The fixing device according to claim 22, wherein the first wall is arranged upstream of the nip in a conveyance direction of a sheet, wherein the third wall is located downstream of the nip in the conveyance direction, wherein the second wall is parallel to the fourth wall, wherein the second bend and the third bend each form a right angle, and wherein the second bend is bent in a direction opposite to a direction in which the first bend and the third bend are bent.

26. A fixing device comprising:

a first fixing member including a roller;

a second fixing member configured to form a nip in combination with the first fixing member;

a heater configured to heat the first fixing member;

a temperature sensor configured to detect a temperature of the first fixing member;

a sensor holder configured to hold the temperature sensor, and a frame on which the sensor holder is fixed, the frame being made of metal, wherein the frame comprises:

a first bend, a second bend, and a third bend each of which has a bent shape in a cross section orthogonal to an axial direction of the roller;

a first wall;

a second wall connected to the first wall via the first bend;

a third wall connected to the second wall via the second bend; and a fourth wall connected to the third wall via the third bend, and wherein the frame has an opening formed across the first wall, the first bend, and the second wall, a part of the sensor holder extending through the opening.

* * * * *